United States Patent [19]

Newberry

[11] 3,966,136

[45] June 29, 1976

[54] REWIND APPARATUS

[75] Inventor: John T. Newberry, Dayton, Ohio

[73] Assignee: Monarch Marking Systems, Inc., Dayton, Ohio

[22] Filed: May 13, 1974

[21] Appl. No.: 469,146

[52] U.S. Cl. ..... 242/67.1 R; 242/67.2; 242/75.5

[51] Int. Cl.[2] ..... B65H 17/04; B65H 25/00

[58] Field of Search ..... 242/75.5, 75.51–75.53, 242/46.4, 207, 189, 75.43, 75.46, 75, 68, 67.1, 67.2, 67.5, 67.3, 67.4; 192/54, 79

[56] References Cited

UNITED STATES PATENTS

| | | | |
|---|---|---|---|
| 1,422,062 | 7/1922 | Hunt | 192/54 X |
| 1,434,970 | 11/1922 | Taylor | 192/54 X |
| 1,725,443 | 8/1929 | Clayton | 242/207 X |
| 2,331,765 | 10/1943 | Carter | 242/75.5 |
| 2,367,140 | 1/1945 | Ress | 242/207 |
| 3,604,650 | 9/1971 | Wennerberg | 242/67.1 R |
| 3,606,200 | 9/1971 | Richt et al. | 242/75.5 X |

*Primary Examiner*—Stanley N. Gilreath
*Assistant Examiner*—John M. Jillions
*Attorney, Agent, or Firm*—Joseph J. Grass

[57] ABSTRACT

There is disclosed apparatus for rewinding a web. The apparatus comprises a simple inexpensive clutch arrangement which gradually applies and removes driving force from a rewind shaft. A pair of bearing sleeves are received about the shaft. The sleeves have cooperable cam surfaces. The first sleeve is continuously driven. A roll in contact with the web senses the tautness or slack in the web and selectively operates a cam to move the sleeves into and out of camming cooperation. When in camming cooperation, the first sleeve binds on the shaft to effect clutching and consequent rotation of the shaft.

19 Claims, 8 Drawing Figures

REWIND APPARATUS

BACKGROUND OF THE INVENTION

1. Field of the Invention

This invention relates to the art of rewind apparatus.

2. Brief Description of the Prior Art

The following prior art U.S patent is made of record: U.S. Pat. No. 2,696,784.

SUMMARY OF THE INVENTION

The primary purposes of the invention is to provide a simple apparatus for gradually applying driving force to a rewind shaft and for gradually removing the driving force so that rewinding can be accomplished smoothly. In prior art rewind apparatus which abruptly apply and remove torque from the rewind shaft various problems can exist such as the application of a jerk to the web upstream from the apparatus. In the disclosed environment of the invention, namely, in a printing press, such a jerk can have an adverse effect on printing registration. Additional disadvantages are possible, e.g., breakage of the web, and the application of abrupt changes in forces on the drive mechanism. According to the invention, a sleeve is received about the rewind shaft. The sleeve is continuously driven and in its one position applies a negligible amount of torque to the rewind shaft. Another sleeve on the shaft has a cam surface which cooperates with a cam surface on the one sleeve so as to effect selectively skewing of the one sleeve on the shaft. By causing the one sleeve to bind on the shaft, as by skewing the one sleeve on the shaft, clutching is effected between the one sleeve and the shaft. A cam plate cooperates with a stationary cam surface on the rewind frame. A roll, under which the web passes, is raised by the web when the web becomes taut and is lowered by the web when the web becomes slack. The roll controls the position of the cam plate selectively to effect movement of the one sleeve into and out of clutching relation relative to the shaft. Wear on the clutching surface of the one sleeve is not detrimental but rather is advantageous in that while skewed there is greater contact between the one sleeve and the shaft. A lost-motion connection in the linkage between the roll and the cam plate prevents the removal of torque from the rewind shaft until after sufficient tension develops in the web. The frame is comprised of a plate which cantilever mounts a pair of guides, the roll and the rewind shaft. This cantilever arrangement allows for easy threading of the web and removal of the rewound web.

DESCRIPTION OF THE PREFERRED EMBODIMENTS

Figure 1:
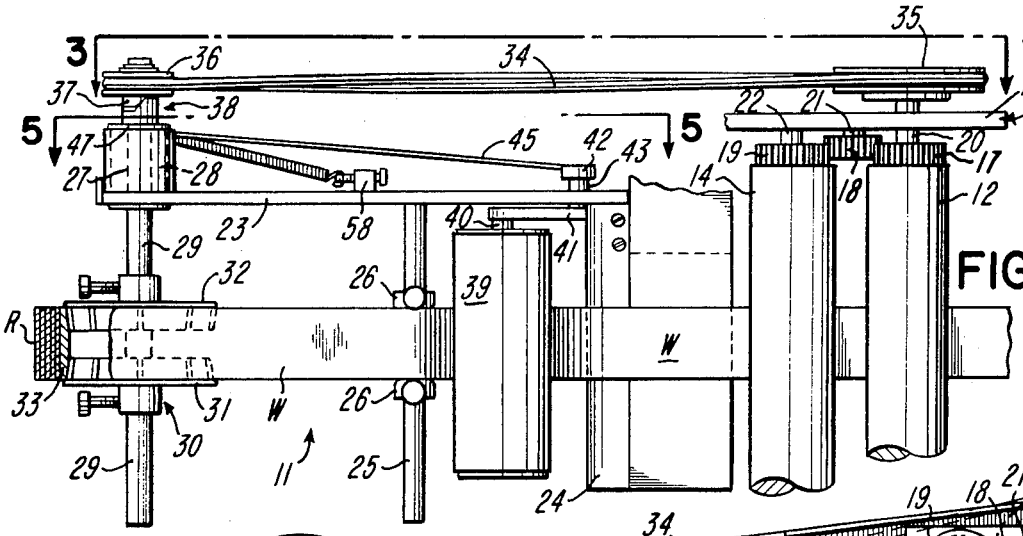
FIG. 1 is a top plan view of rewind apparatus together with printing apparatus.
Figure 2:
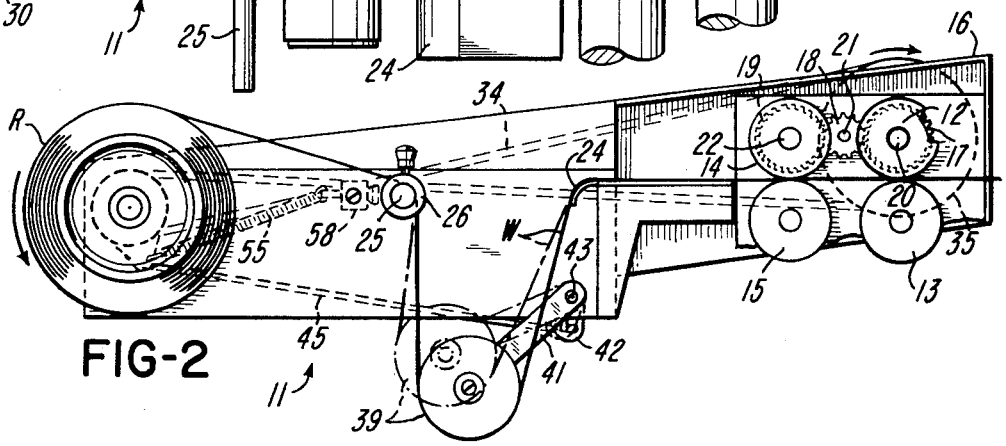
FIG. 2 is a side elevational view of apparatus shown in FIG. 1.
Figure 3:
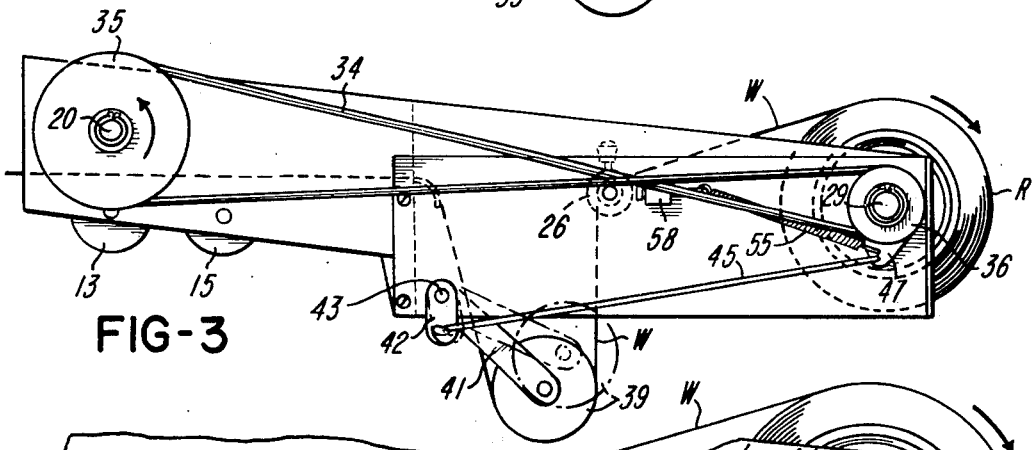
FIG. 3 is a side elevational view taken along line 3—3 of FIG. 1.

Referring to FIGS. 1, 2 and 3, there is shown printing apparatus generally indicated at 10 and rewind apparatus generally indicated at 11. The printing apparatus 10 is known per se in the prior art and includes a pair of feed rolls 12 and 13, a printing roll 14 and a platen roll 15 mounted in a suitable frame 16. The feed roll 12 and the printing roll 14 are driven in synchronism through gears 17, 18 and 19. The gears 17, 18 and 19 are secured to respective shafts 20, 21 and 22 journaled in the frame 16. Because of the discontinuous nature of the outer surface of the roll 12 indicated at 17 the web W is advanced intermittently by the rolls 12 and 13.

The rewind apparatus 11 comprises a frame 23 bolted to the printing press frame 16. A curved guide 24 and a round shaft or guide 25 are secured to one side of the rewind frame 23. A pair of side guides 26 are adjustably secured to the guide 25 so as to accommodate a web W of any width. A frame member or bearing block 27 of the frame 23 mounts a bearing 28. A rewind shaft 29 is rotatably mounted in the bearing 28. A hub generally indicated at 30 comprised of a pair of hub members 31 and 32 is adjustably secured to the shaft 29 to be able to rewind a web W of any desired width. In the illustrated embodiment, the hub members 31 and 32 are shown to mount a suitable core 33 onto which web W is rewound.

A suitable pulley belt 34 passes over a pulley 35 secured to the shaft 20 and over a pulley 36 secured to a sleeve 37. In that the shaft 20 rotates continuously, pulleys 36 and 38 and the sleeve 37 also rotate continuously. The pulley 36 is considered to be an input member. As best shown in FIGS. 2 and 3, the pulley belt 34 makes a figure eight so that the pulleys 35 and 36 rotate in the opposite directions. The sleeve 37 and the shaft 29 cooperate to provide a clutch generally indicated at 38.

Figure 8:
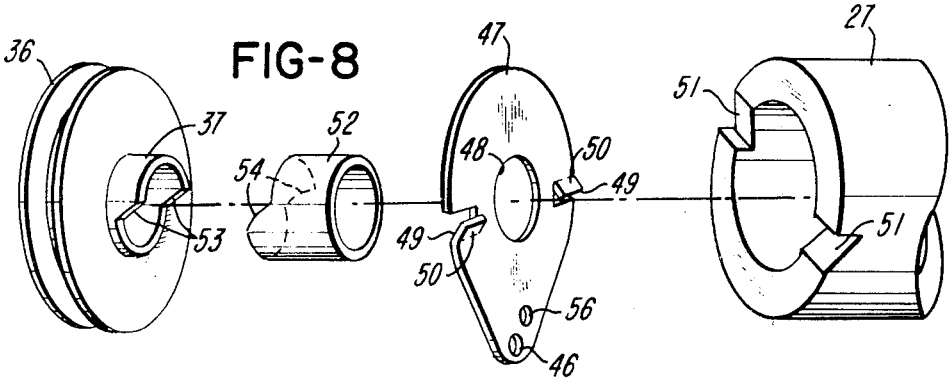
FIG. 8 is an exploded perspective view of the drive input, the clutch and part of the clutch control structure.

As shown in FIGS. 2 through 5, the web W passes around the guide 24, downwardly and under and around a roll 39. From the roll 39 the web W extends up and over the guide 25 to the web roll R. The roll 39 is rotatably mounted on a shaft 40 which is secured to a link 41. The arm 41 and an arm 42 are secured to a shaft 43 which is journaled in the rewind frame 23. The link 42 has an elongated slot 44 best shown in FIG. 4 which provides a lost motion connection between the link 42 and a rigid rod 45. The one end of the rod 45 is bent at a right angle and is received in the slot 44 and its other bent end is received in a hole 46 in a cam plate 47. The cam plate 47 has a hole 48 (FIG. 8) which receives the shaft 29. Accordingly, shifting movement of the rod 45 will cause the cam plate 47 to rotate on the shaft 29.

The cam plate 47 is comprised of a generally flat metal plate having diametrically opposed outturned portions 49 with cam surfaces 50. The frame member 27 has cam surfaces 51 with which the cam surfaces 50 can cooperate. Movement of the cam plate 47 from the position shown in FIG. 7 to the position shown in FIG. 6 causes the cam plate 47 to rotate and shift in a direction axial to the shaft 29 so as to move a sleeve 52, which receives the shaft 29, toward the sleeve 37. The sleeve 37 has cam surfaces 53 and the sleeve 52 has cooperable cam surfaces 54. The cam surfaces 53 and 54 are shown to be in camming cooperation in FIG. 6, to be touching but out of camming cooperation in FIG. 7. In the position shown in FIG. 6, sleeve 37 and the pulley 36 which it mounts are shown to be slightly skewed with respect to the shaft 29. In the skewed position of the sleeve 37, the sleeve 37 exerts a binding force on the shaft 29 to effect clutching engagement between the rotating sleeve 3 and the shaft 29. This clutching engagement causes the shaft 29 to rotate. Rotation of the shaft 29 causes the hub 30 to rotate and the web W to be wound onto the core 33. The sleeves 37 and 52 are comprised of porous lubricant-containing bearing material such as sintered bronze in which pores in the material act as reservoirs for lubricant. Such materials are commercially sold under the name "Oilite".

Figure 4:
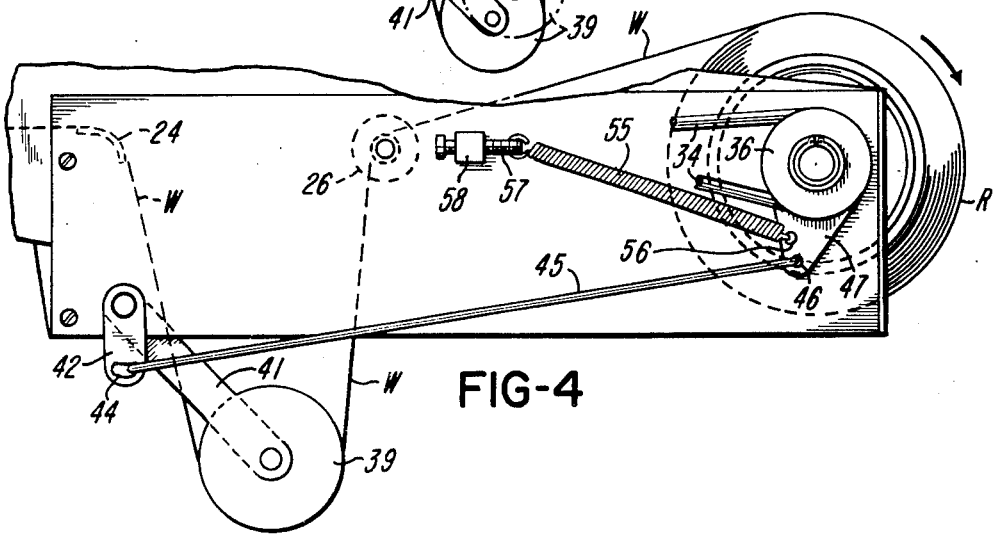
FIG. 4 is an enlarged, fragmentary, side elevational view of the apparatus.
Figure 5:
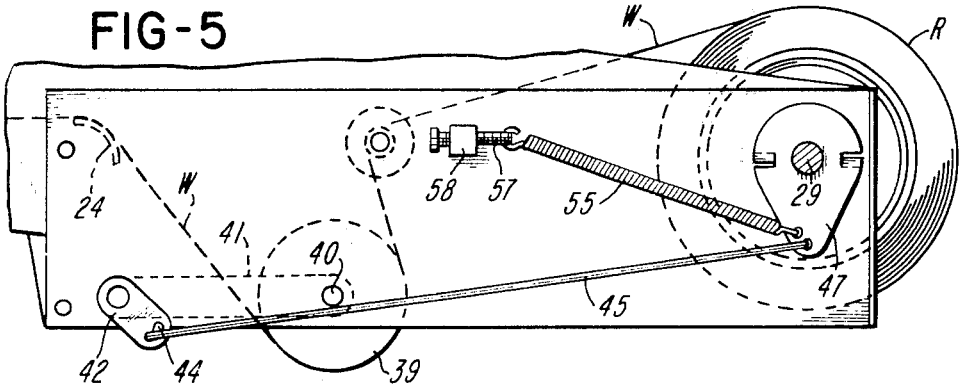
FIG. 5 is a view taken generally along line 5—5 of FIG. 1.

With reference to FIGS. 3 and 4, the roll 39 is shown in its lowered position in which there is little tension in the web W. In this position, the link 42 and arm 41 are in their clockwise positions and consequently the cam plate 47 is also in its clockwise position. In the clockwise position of the cam plate 47 (FIGS. 3, 4 and 5), the cam plate 47, and the sleeves 37 and 52 are in their cooperating position shown in FIG. 6. Because of the relative sizes of the pulleys 35 and 36, the shaft 29 will rotate at a greater angular speed than the shaft 20. Also, the peripheral speed of the web roll R is greater than the speed of the intermittently fed web W. Accordingly, tension in the web W will increase until the roll 39 is in the position shown by phantom lines in FIG. 3. In this position one end of the rod 45 has moved to the other end of the elongated slot 44 and the cam plate 47 has been rotated counterclockwise as best shown in FIG. 5, thereby moving the cam plate 47 to the position shown in FIG. 5. When the cam plate 47 is in the position shown in FIG. 5, the same position in which the cam plate 47 is shown in FIG. 7, the sleeve 52 has moved to the position shown in FIG. 7, and the sleeve 37 is no longer skewed on the shaft 29. Because of the clearance, illustrated exaggeratedly in FIG. 7, the sleeve 37 rotates freely relative to the shaft 29 which is now stationary.

Figure 6:
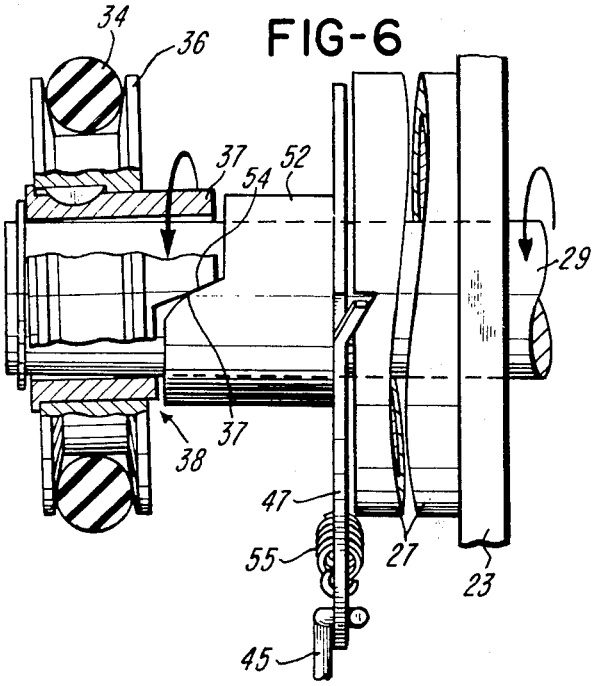
FIG. 6 is a fragmentary partly sectional view of the clutch arrangement of the rewind apparatus, in the clutched position.
Figure 7:
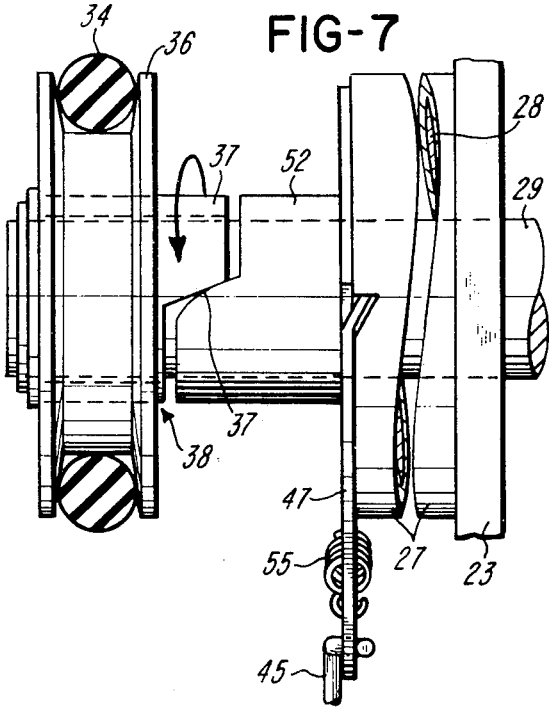
FIG. 7 is a view similar to FIG. 6, but showing the clutch arrangement in the unclutched position.

Should slack again develop in the web W due to the fact that the feed rolls 12 and 13 are feeding the web and the rewind shaft 29 is not rotating, the roll 29 will again descend to the position shown in FIGS. 3 and 4 and the associated parts including the cam plate 47 and the sleeve 52 will move to the position shown in FIG. 6, thereby effecting clutching of the sleeve 37 and the shaft 29.

The lost-motion connection provided by the slot 44 and the turned-in end of the rod 45 will enable the roll 39 to be raised a limited amount before the cam plate 47 is shifted from the position shown in FIG. 7 to the position shown in FIG. 6. The relatively small weight of the roll 39 is such that the slight increase in tension which causes the roll 39 to rise prevents the apparatus 11 from becoming too highly sensitive to changes in web tension.

A spring 55 passes at one end through a hole 56 in the cam plate 47 and is connected at its other end to an adjusting screw 57 threadably received in a block 58 mounted to the frame 23. The spring 55 acts to normally urge the cam plate 47 to its clockwise position as viewed in FIG. 4, for example, and to urge the rod 45 into the position shown in FIG. 4. As the roll 39 is raised and the end of the rod 45 bottoms in the other end of the slot 44 of the link 42, the spring 55 adds resistance to raising of the roll 39. The more the resistance the more delay is before the clutch 38 is engaged and the sooner the clutch 38 will be disengaged. The screw 57 can be adjusted to increase the force on the cam plate 47 and the associated structure. Thus, the amount of tension in the web W is related to the force exerted by the spring 55.

As best seen in FIG. 1 the guides 24 and 25, the roll 39 and the shaft 29 are shown to be mounted by the rewind frame 23 in a cantilevered arrangement. This cantilevered arrangement facilitates easy access to the web W as when threading the web W through the apparatus and when removing a web roll R of the rewound web. This cantilevered arrangement is also conducive to low-cost manufacture in that there are no bearings to align and no concomitant misalignment problems.

Other embodiments and modifications of this invention will suggest themselves to those skilled in the art, and all such of these as come within the spirit of this invention are included within its scope as best defined by the appended claims.

I claim:

1. Apparatus for rewinding a web, comprising: a rotatably mounted shaft, first and second sleeves rotatably received on the shaft, means for continuously driving the first sleeve, the first and second sleeves having respective first and second cam surfaces, the cam surfaces being cooperable to cause the first sleeve to skew slightly on the shaft to cause the first sleeve to clutch the shaft, a hub driven by the shaft onto which a web can be wound, web tension sensing means responsive to tautness and slack in the web, and actuating means controlled by the sensing means for effecting movement of the cam surfaces of the first and second sleeves into cooperation when slack exists in the web and for effecting movement of the cam surfaces out of cooperation when tautness exists in the web.

2. Apparatus as defined in claim 1, including a frame, a bearing mounted by the frame for rotatably mounting the shaft, the actuating means comprising a third cam surface on the frame and a cam plate rotatably received by the shaft between the frame and the second sleeve, the cam plate having a fourth cam surface, the third and fourth cam surfaces being cooperable when the sensing member senses slack in the web to drive the first and second cam surfaces of the first and second sleeves together to clutch the first sleeve to the shaft, the third and fourth cam surfaces being out of cooperation when the sensing member senses tautness in the web to allow the first sleeve to be unclutched from the shaft.

3. Apparatus as defined in claim 1, wherein the first sleeve is comprised of a porous lubricant-containing bearing material.

4. Apparatus as defined in claim 3, a frame, wherein the shaft is mounted in cantilevered relation by the frame to allow for ready access to the web.

5. Apparatus for rewinding a web, comprising: a rotatably mounted shaft, means driven by the shaft for winding up a web, a sleeve mounted on and in contact with the shaft and rotatable relative to the shaft while the sleeve is unclutched from the shaft, means for driving the sleeve, means for effecting binding of the sleeve on the shaft to effect clutching between the sleeve and the shaft, and means responsive to tautness in the web for actuating the binding means and responsive to slack in the web for deactuating the binding means, wherein the actuating and deactuating means includes a sensing member responsive to increases and decreases in tension in the web, the binding means includes a movable member for causing the sleeve to skew relative to the shaft, and means including a linkage responsive to movement of the sensing member for effecting movement of the movable member.

6. Apparatus as defined in claim 5, wherein the drive shaft is more wear resistant at the place of contact with the sleeve than the surface of the sleeve which contacts the drive shaft so that sleeve wears faster than the drive shaft.

7. Apparatus as defined in claim 5, including a stationary frame member having a cam surface, wherein the actuating and deactuating means includes a cam surface cooperable with the frame member cam surface to effect clutching between the sleeve and the shaft.

8. Apparatus as defined in claim 5, including another sleeve received about the shaft and shiftable in directions toward and away from the one sleeve to effect clutching and declutching respectively between the one sleeve and the shaft.

9. Apparatus as defined in claim 5, wherein the actuating and deactuating means includes a spring for normally urging the sleeve into clutched relationship with the shaft.

10. Apparatus as defined in claim 5, including means for regulating the minimum amount of tension maintained in the web.

11. Apparatus as defined in claim 5, wherein the sleeve is comprised of a porous lubricant-containing bearing material.

12. Apparatus as defined in claim 5, wherein the actuating and deactuating means includes a lost motion connection.

13. Apparatus for rewinding a web, comprising: frame means, a roll movably mounted by the frame means, a shaft rotatably mounted by the frame means, a hub carried by the shaft, guide means mounted to the frame means for guiding a web around the underside of the roll and from there onto the hub, the frame means including a stationary cam with a stationary cam surface, a cam plate mounted on the shaft and having a cam surface cooperable with the stationary cam surface, means responsive to increase in tension in the web for moving the cam plate in one direction and responsive to decrease in tension in the web for moving the cam plate in the opposite direction, first and second sleeves rotatably mounted on the shaft, means for continuously driving the first sleeve, the second sleeve being between the cam plate and the first sleeve, the first and second sleeves having respective first and second cam surfaces, rotation of the cam plate in the one direction causing the cam plate to push the second sleeve toward the first sleeve to skew the first sleeve on the shaft to cause the first sleeve to be clutched with the shaft and rotation of the cam plate in the opposite direction causing the cam plate to move out of pushing relation with the second sleeve to cause the first sleeve to be declutched from the shaft.

14. Apparatus as defined in claim 13, wherein the means for moving the cam plate includes a lost motion connection to delay movement of the cam plate in the one direction when the tension in the web increases.

15. Apparatus as defined in claim 13, wherein the roll and the shaft are mounted in cantilevered relation by the frame means to allow ready access to the web.

16. Apparatus as defined in claim 13, wherein the first and second sleeves are each comprised of a porous lubricant-containing bearing material.

17. Apparatus for rewinding a web, comprising: a rotatably mounted shaft, means driven by the shaft for winding up a web, a sleeve mounted on and in contact with the shaft and rotatable relative to the shaft while the sleeve is unclutched from the shaft, means for continuously driving the sleeve, and skewing means including actuating means responsive to slack and tautness in the web for skewing the sleeve on the shaft to effect clutching and declutching respectively between the sleeve and the shaft.

18. Apparatus as defined in claim 17, wherein the skewing means comprises a cam for actuating the sleeve to effect clutching between the sleeve and the shaft.

19. Apparatus as defined in claim 17, wherein the sleeve is comprised of a porous lubricant-containing bearing material.

* * * * *

UNITED STATES PATENT OFFICE

CERTIFICATE OF CORRECTION

Patent No. 3,966,136 Dated June 29, 1976

Inventor(s) John T. Newberry

It is certified that error appears in the above-identified patent and that said Letters Patent are hereby corrected as shown below:

Column 2, line 41, "the", first occurrence should be deleted.

Column 3, line 9, "3" should be -- 37 --.

Signed and Sealed this

Thirtieth Day of November 1976

[SEAL]

*Attest:*

RUTH C. MASON
*Attesting Officer*

C. MARSHALL DANN
*Commissioner of Patents and Trademarks*